United States Patent [19]

Clark et al.

[11] 4,039,974

[45] Aug. 2, 1977

[54] COAXIAL RADIO FREQUENCY SWITCH HAVING INTEGRAL FILTER

[75] Inventors: Neill V. Clark, Sunnyvale; Homer G. Holzgrafe, Santa Barbara, both of Calif.

[73] Assignee: Raytheon Company, Lexington, Mass.

[21] Appl. No.: 610,367

[22] Filed: Sept. 4, 1975

[51] Int. Cl.[2] ..... H01P 1/12

[52] U.S. Cl. ..... 333/7 R; 333/73 C

[58] Field of Search ..... 333/7 R, 7 D, 24 C, 333/97 S, 73 C

[56] References Cited

U.S. PATENT DOCUMENTS

| | | | |
|---|---|---|---|
| 2,426,186 | 8/1947 | Dow | 333/7 R X |
| 2,452,202 | 10/1948 | Lindenblad | 333/7 R X |
| 2,968,772 | 1/1961 | Thomas, Jr. | 333/73 C |
| 3,132,311 | 5/1964 | Wozniak | 333/97 R X |
| 3,309,632 | 3/1967 | Trudeau | 333/97 R X |
| 3,530,504 | 9/1970 | Konishi | 333/7 R X |
| 3,969,690 | 7/1976 | Hansen et al. | 333/7 R |

*Primary Examiner*—Paul L. Gensler
*Attorney, Agent, or Firm*—Richard M. Sharkansky; Philip J. McFarland; Joseph D. Pannone

[57] ABSTRACT

A coaxial transmission line switch is disclosed, such switch having a rotatable coupling element reactively coupled between an input coaxial transmission line and a selected one of a plurality of output coaxial transmission lines. The rotatable conducting element, the input coaxial transmission line, and the plurality of output coaxial transmission lines have shunt connected radio frequency stubs thereby forming a filter integrally with the coaxial transmission line switch.

5 Claims, 4 Drawing Figures

COAXIAL RADIO FREQUENCY SWITCH HAVING INTEGRAL FILTER

BACKGROUND OF THE INVENTION

This invention relates generally to radio frequency switches and more particularly to coaxial transmission line switches.

As is known in the art, one type of coaxial transmission line switch includes a rotatable coupling element in contact with the center conductor of an input coaxial transmission line and adapted for contacting the center conductor of a selected one of a plurality of output coaxial transmission lines. Such switch is described in "Microwave Transmission Circuits" edited by George L. Ragan, published and distributed by Boston Technical Publishers, Inc., 5 Bryant road, Lexington, Mass. 02173, 1974 edition. While such type of coaxial transmission line switch has been found adequate in many applications, the power handling capability and life of such type of coaxial transmission line switch is limited because of the possibility of voltage breakdown resulting from metal shavings from the contacting center conductors being present in the region of strong radio frequency fields.

It is also known in the art that it is sometimes desirable to form filters from sections of coaxial transmission lines. Such filters may be formed because, at radio frequencies, a capacitor may be realized in a coaxial transmission line by a series gap in the center conductor of such transmission line and an inductor may be realized by a proper length of shorted transmission line, (i.e. a radio frequency stub) connected in shunt to the center conductor of the coaxial transmission line. further, such "capacitors" and "inductors" may be arranged to enable the filter formed from such coaxial transmission line to provide for matching between the impedance of the source driving such transmission line and the impedance of the load coupled to the output of such transmission line. It would sometimes be desirable to incorporate such a filter integrally with a coaxial transmission line switch, however, the coaxial transmission line switch described above does not include such an integrally formed filter.

SUMMARY OF THE INVENTION

It is therefore an object of this invention to provide an improved coaxial transmission line switch.

It is another object of this invention to provide an improved coaxial transmission line switch having a rotatable coupling element coupled to an input coaxial transmission line and a selected one of a plurality of output coaxial transmission lines, such rotatable coupling element not being required to be in contact with the center conductors of such selected one of the plurality of output coaxial transmission lines and the center conductor of the input coaxial transmission line.

It is another object of this invention to provide an improved coaxial transmission line switch having a filter integrally formed therewith.

These and other objects of the invention are attained generally by providing a coaxial transmission line switch having a rotatable coupling element reactively coupled between an input coaxial transmission line and a selected one of a plurality of output coaxial transmission lines. In a preferred embodiment of the invention such rotatable conducting element has a shunt connected radio frequency stub and the input coaxial transmission line and the plurality of output coaxial transmission lines also have shunt connected radio frequency stubs, thereby forming a filter integrally with the coaxial transmission line switch.

BRIEF DESCRIPTION OF THE DRAWINGS

The above and other objects of the invention will become better understood by reference to the following description taken together in conjunction with the accompanying drawings, in which.

DESCRIPTION OF THE PREFERRED EMBODIMENT

Figure 1:
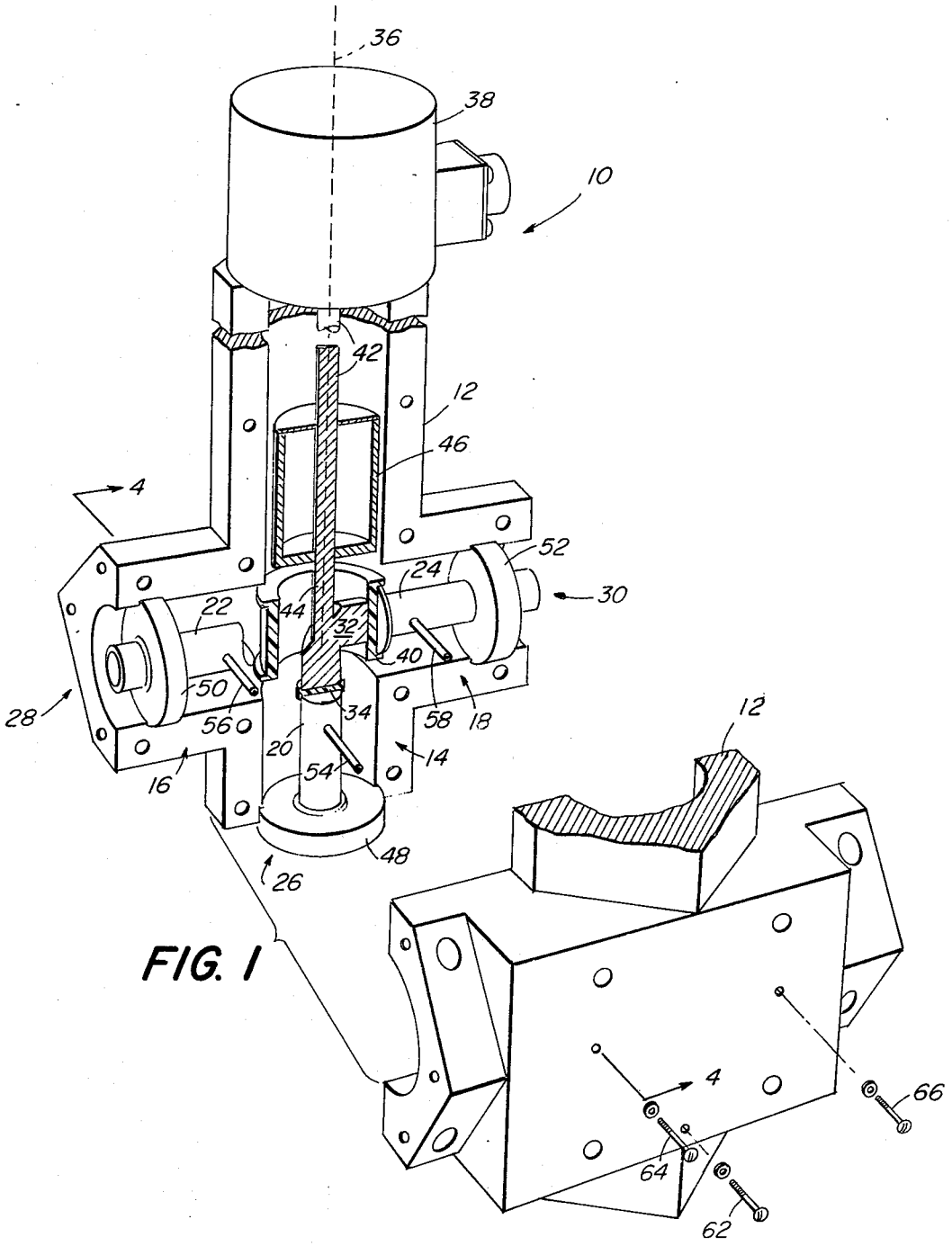
FIG. 1 is an exploded isometric drawing, partially broken away and partially cross-sectional, showing the coaxial transmission line switch according to our invention.
Figure 2:
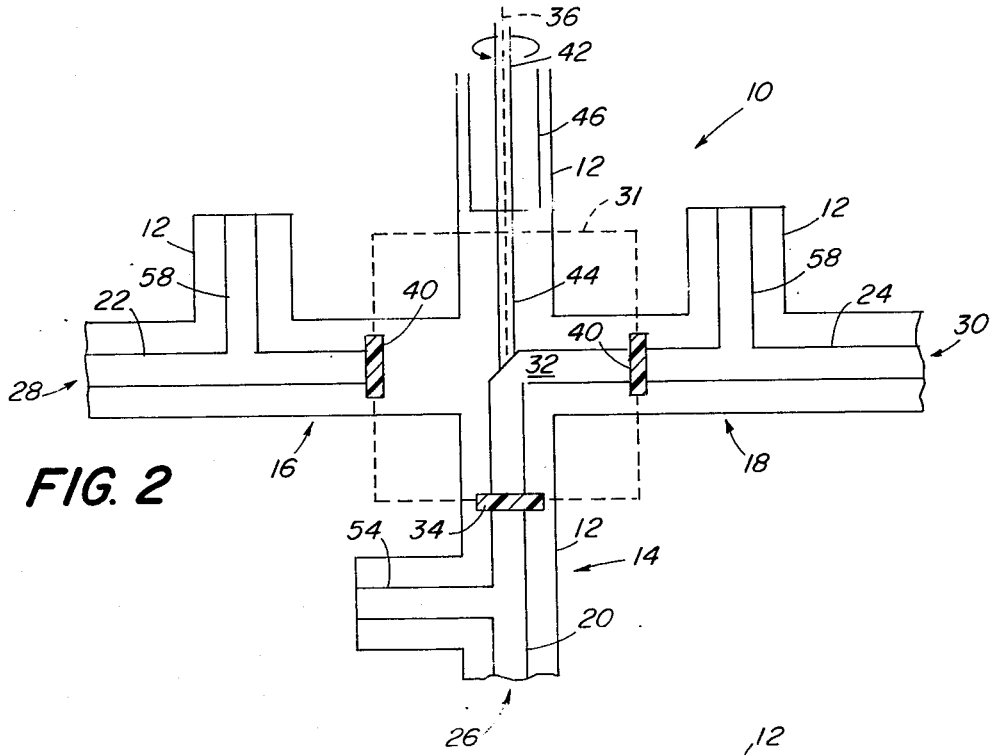
FIG. 2 is a diagrammatic drawing of the coaxial transmission line switch shown in FIG. 1, such drawing being useful in understanding features of such switch.
Figure 4:
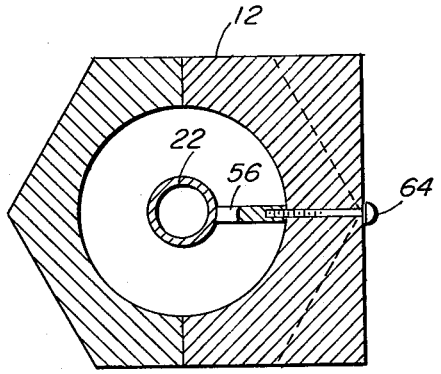

Referring now to FIG. 1, a coaxial transmission line switch 10 is shown, and a diagrammatical sketch thereof is shown in FIG. 2. Such switch 10 includes a housing 12 made of any suitable electrical conductive material, here aluminum. Such housing 12 forms the outer conductor of three coaxial transmission lines 14, 16, 18, the inner center conductors of such coaxial transmission lines being conductors 20, 22, 24 respectively, here hollow aluminum tubes. It is here noted that the housing 12 is in two sections which are bolted together by conventional bolts, not shown. One end of the coaxial transmission lines 14, 16, 18 forms input port 26 and output ports 28, 30 respectively and the other end of transmission lines 14, 16, 18 is disposed in the common region 31 (such region not being numbered in FIG. 1 but being numbered in FIG. 2). Disposed in such common region 31 is a switching arm 32, here also made of aluminum, one end of which is capacitively coupled to the center conductor 20 of the coaxial transmission line 14 through a dielectric disc 34. The switching arm 32 is adapted to rotate about axis 36 here by a conventional motor drive unit 38 so that the second end of such arm 32 may be capacitively coupled to a selected one of the center conductors 22, 24 through a dielectric ring 40. In particular the shaft 42 of the motor 38 is mechanically coupled in any conventional manner to a radio frequency stub 44 formed integrally with the arm 32. Also formed integrally with such arm 32 is a conductive cu-shaped element 46 which is rotatable within the housing 12. It is noted that the cup-shaped conductive element 46 is cylindrically shaped and has an electrical length sufficient to effectuate a radio frequency short circuit between such element 46 and the housing 12. Such cup-shaped conductive element 46 has an electrical length $\lambda/4$ where $\lambda$ is the nominal operating wavelength of the switch 10. Such conductive element 46 serves to inhibit radio frequency energy passing through such switch 10 from coupling into the drive unit 38 and electrical cables (not shown) coupled to such drive unit. Such conductive element 46 then provides a short circuit radio frequency stub in shunt to the switching arm 32. Dielectric discs 48, 50, 52 are provided to support one end of each one of the center conductors 20, 22, 24 respectively within the housing 12. The other end of the center conductors 22, 24 is supported, in part, by a channel formed in the dielectric ring 40. Support for the center conductor 20 is in part provided by a recess formed in dielectric disc 34 as shown. Radio frequency stubs 54, 56, 58 are formed integrally with the center conductors 20, 22, 24 and provide short circuit radio frequency stubs in shunt to the center conductors, 20, 22, 24, as indicated. Such radio frequency stubs 54, 56, 58 are fastened to the housing 12 by conventional screws 62, 64, 66 respectively as indicated in FIG. 1. As shown more clearly in FIG. 4, with regard to screw 64 and stub 56, such stubs 54, 56, 58 are drilled and tapped. Screws 62, 64, 66 are inserted through housing 12 and then screwed into the drilled and tapped holes thereby ensuring electrical connection between the center conductors 20, 22, 24 and the housing 12. The radio frequency stubs 54, 56, 58, fastened to the housing 12 as described, provide additional support for the center conductors 20, 22, 24 and also provide thermal conductive paths for extracting heat from such center conductors.

Figure 3:
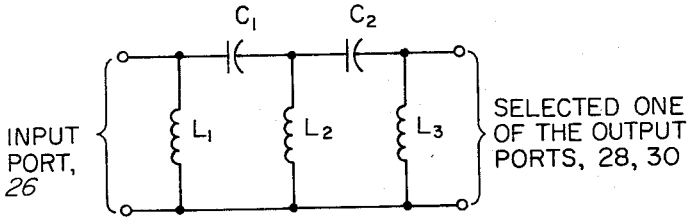
FIG. 3 is a schematic diagram useful in understanding features of the coaxial transmission line switch; and, FIG. 4 is a cross-sectional view of the coaxial transmission line switch shown in FIG. 1, such cross-section being taken along line 4—4 in such FIG. 1.

Referring now to FIG. 3, an equivalent circuit of the radio frequency switch 10 is shown. In such circuit: ratio frequency stub 54 forms an inductor $L_1$; center conductor 20, dielectric disc 34 and arm 32 form a capacitor $C_1$; radio frequency stub 44 forms the inductor $L_2$; arm 32, ring 40 and the selected one of the center conductors 22, 24 form the capacitor $C_2$; and, the one of the stubs 56, 58 of the selected center conductor forms the inductor $L_3$. The equivalent circuit shown in FIG. 3 is that of a Tchebychef filter.

Having described a preferred embodiment of this invention, it is now evident that other embodiments incorporating its concepts may be used. It is felt, therefore, that this invention should not be restricted to such preferred embodiment but rather should be limited only by the spirit and scope of the appended claims.

What is claimed is:

1. A coaxial transmission line switch comprising:

a. a housing for such switch;

b. an input coaxial transmission line;

c. a plurality of output coaxial transmission lines, such housing providing outer conductors for the input coaxial transmission line and the plurality of output coaxial transmission lines;

d. a radio frequency filter, comprising:

a plurality of radio frequency stubs having first ends thereof connected to center conductors of the input coaxial transmission line and the plurality of output coaxial transmission lines;

and a rotatable coupling element, disposed in the housing, reactively coupled between the input coaxial transmission line and a selected one of a plurality of output coaxial transmission lines, such filter being formed integrally with the switch to filter signals fed to the input coaxial transmission line and coupled to the selected one of the plurality of output coaxial transmission lines.

2. The switch recited in claim 1 wherein the plurality of stubs have second ends connected to the housing to provide at least partial support of the inner conductors connected thereto within the housing.

3. The switch recited in claim 2 wherein the plurality of stubs are arranged to provide a heat conduit between the center conductors and the housing.

4. The switch recited in claim 3 wherein the filter formed by the filter means is a Tchebychef filter.

5. The switch recited in claim 4 including a radio frequency stub rotatably mounted within the housing and connected to the rotatable coupling element, such rotatable stub being electrically short circuited to the housing.

* * * * *

UNITED STATES PATENT OFFICE

CERTIFICATE OF CORRECTION

Patent No. 4,039,974 Dated August 2, 1977

Inventor(s) Neill V. Clark and Homer G. Holzgrafe

It is certified that error appears in the above-identified patent and that said Letters Patent are hereby corrected as shown below:

Column 2, line 54, delete "cu-shaped" and insert therefor -- cup-shaped --

Signed and Sealed this

*Twenty-fifth* Day of *October 1977*

[SEAL]

*Attest:*

RUTH C. MASON
*Attesting Officer*

LUTRELLE F. PARKER
*Acting Commissioner of Patents and Trademarks*